US005873421A

United States Patent [19]

Assenza

[11] Patent Number: 5,873,421

[45] Date of Patent: Feb. 23, 1999

[54] TOOL FOR INSTALLING A PIPELINE UNDER A STRUCTURE

[76] Inventor: Antonio Assenza, 8718 Via Reale, Boca Raton, Fla. 33496

[21] Appl. No.: 907,404

[22] Filed: Aug. 7, 1997

Related U.S. Application Data

[60] Provisional application No. 60/037,612 Feb. 12, 1997.

[51] Int. Cl.[6] ..... E21B 3/02

[52] U.S. Cl. ..... 175/121; 175/122; 175/171; 175/203

[58] Field of Search ..... 175/62, 113, 121, 175/122, 135, 162, 171, 203; 173/148

[56] References Cited

U.S. PATENT DOCUMENTS

| | | | |
|---|---|---|---|
| 3,107,741 | 10/1963 | Adams et al. | 175/122 |
| 3,162,254 | 12/1964 | Rose | 173/148 |
| 3,682,261 | 8/1972 | Bird | 175/122 |
| 3,902,322 | 9/1975 | Watanabe | 175/171 X |
| 4,124,082 | 11/1978 | Garver | 175/62 |
| 4,553,612 | 11/1985 | Durham | 175/171 X |
| 4,790,395 | 12/1988 | Gack et al. | 175/203 X |
| 5,355,966 | 10/1994 | Mathis | 175/135 X |

*Primary Examiner*—Roger J. Schoeppel
*Attorney, Agent, or Firm*—Joseph Zallen

[57] ABSTRACT

A tool for installing an underground pipeline below an existing structure such as a sidewalk or driveway. The tool consists of a steel casing, an auger within the casing, a soil drilling bit at the end of the auger, and an hydraulic motor for driving the auger. A selected length of plastic or steel pipe is slid onto the casing before drilling. After the drilling is completed, the casing, auger, and auger bit are withdrawn from the soil, leaving the pipe length embedded in the soil.

8 Claims, 3 Drawing Sheets

TOOL FOR INSTALLING A PIPELINE UNDER A STRUCTURE

BACKGROUND OF INVENTION

Provisional application sn. 60/037,612, filed Feb. 12, 1997 is hereby incorporated herein by reference.

This invention relates to the installation of underground pipelines. In particular, it relates to the installation of underground pipelines for utilities such as gas, water, sewer, telephone, and electricity.

In developed areas it is often necessary to lay the pipeline below existing structures such as sidewalks, driveways, and the like, where the width can vary widely. With present equipment it is necessary to break up the sidewalk or driveway, lay the pipeline, and then restore the structure.

One object of the present invention is to provide an apparatus and method for quickly, precisely, and inexpensively installing a pipeline below a structure such as a sidewalk or driveway without breaking up the structure. Other objects and advantages of this invention will be apparent from the description and claims which follow, taken together with the appended drawings.

SUMMARY OF INVENTION

The invention comprises generally drilling below the surface of the structure at a satisfactory depth with an auger housed in a steel casing covered with the pipe section to be installed. Before beginning the drilling, a pipe section of appropriate length is slipped over the steel casing and the drilling bit attached to the auger. Bits that can be used depend on the nature of the soil, a large number of bits being commercially available. Replaceable, conical, carbide cutter teeth are preferably used. When the auger is turning the bit, the teeth go outward to accomplish the drilling of the soil, but when the auger is not rotating, the teeth fold back so that withdrawing of the steel casing also permits simultaneous withdrawal of the auger and auger bit.

When the bit is driven into the soil, it clears sufficient space to permit the entire assembly of pipe section, casing, and auger to move through the space together. When the desired boring has been completed, the steel casing, auger, and bit are withdrawn, leaving the pipe section in place in the soil under the structure.

The apparatus for carrying out the invention comprises a steel housing supporting an hydraulic motor, an auger, a steel casing, and auger bit. The auger bit is preferably interchangeable. The hydraulic motor can be powered from other construction equipment, as for example the hydraulic system of a backhoe, in which case quick-connect hydraulic hoses can be used to attach the motor to the hydraulic system. The backhoe can also be used to move the apparatus and control its operation. The conventional backhoe is commonly provided with a bucket which can be removed and substituted by a suitable quick coupling. The quick coupling can latch onto the steel housing so as to readily position the apparatus where needed.

Depending on the soil, a complete bore for a 24-foot run can be completed in 15 to 30 minutes where the casing diameter varies between 5–10 inches. The apparatus of the invention can bore and simultaneously install pipeline sections of diverse materials such as plastic or steel.

SPECIFIC EXAMPLE OF INVENTION

Figure 1A:
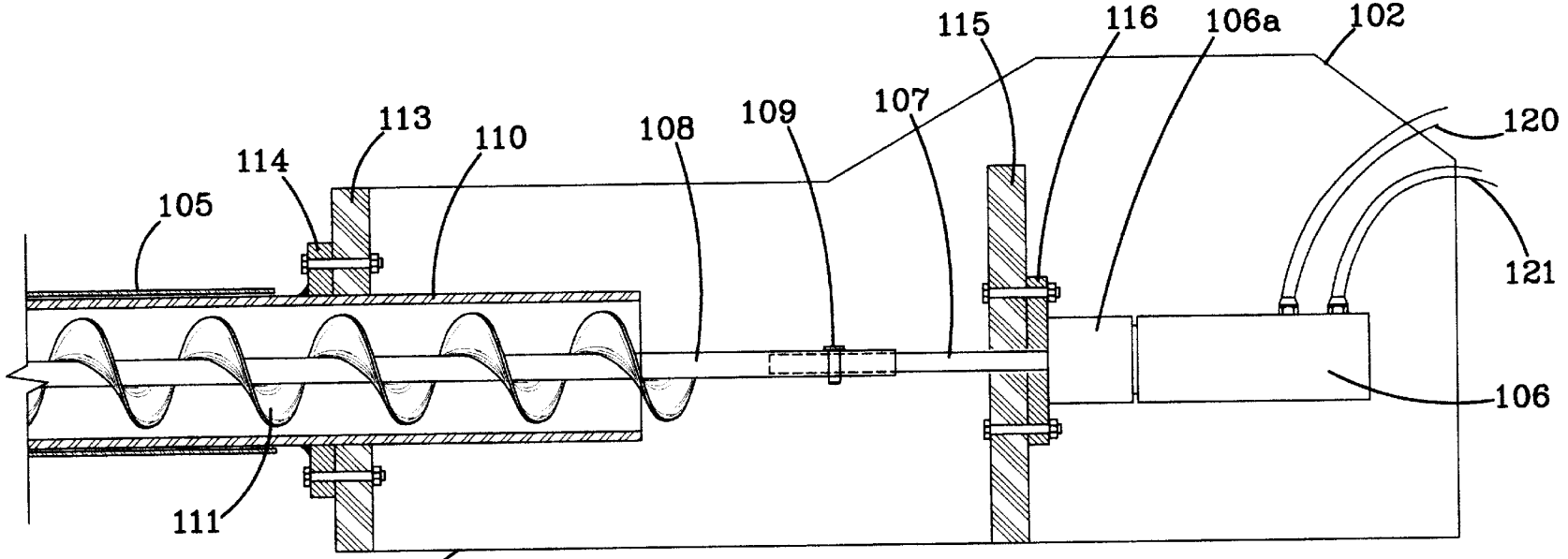
FIG. 1A and FIG. 1B represent a cross-section of one embodiment of the present invention.
Figure 2:
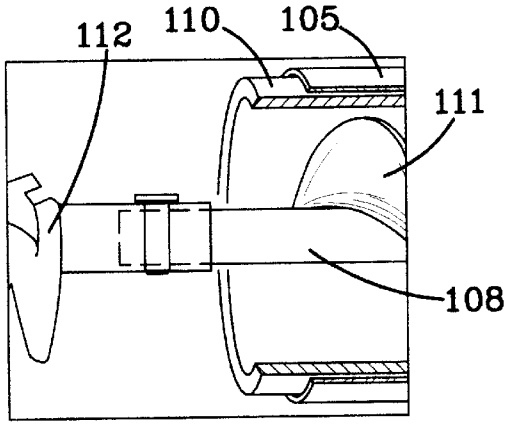
FIG. 2 represents an enlarged cutaway of a portion of FIG. 1B.
Figure 1B:
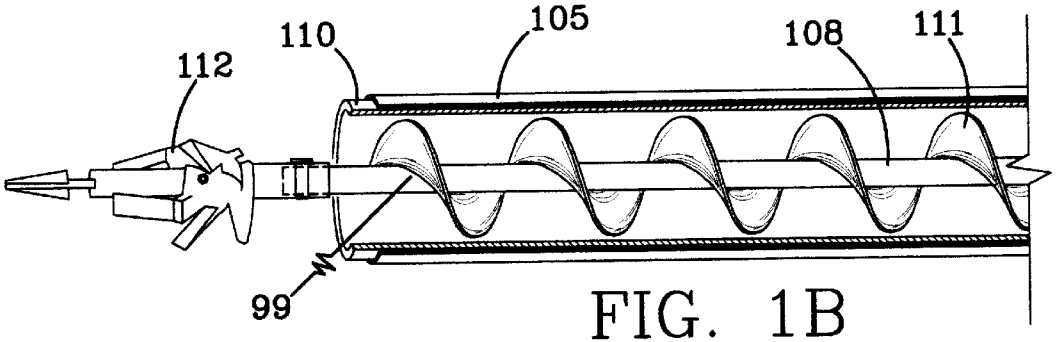
Figure 3:
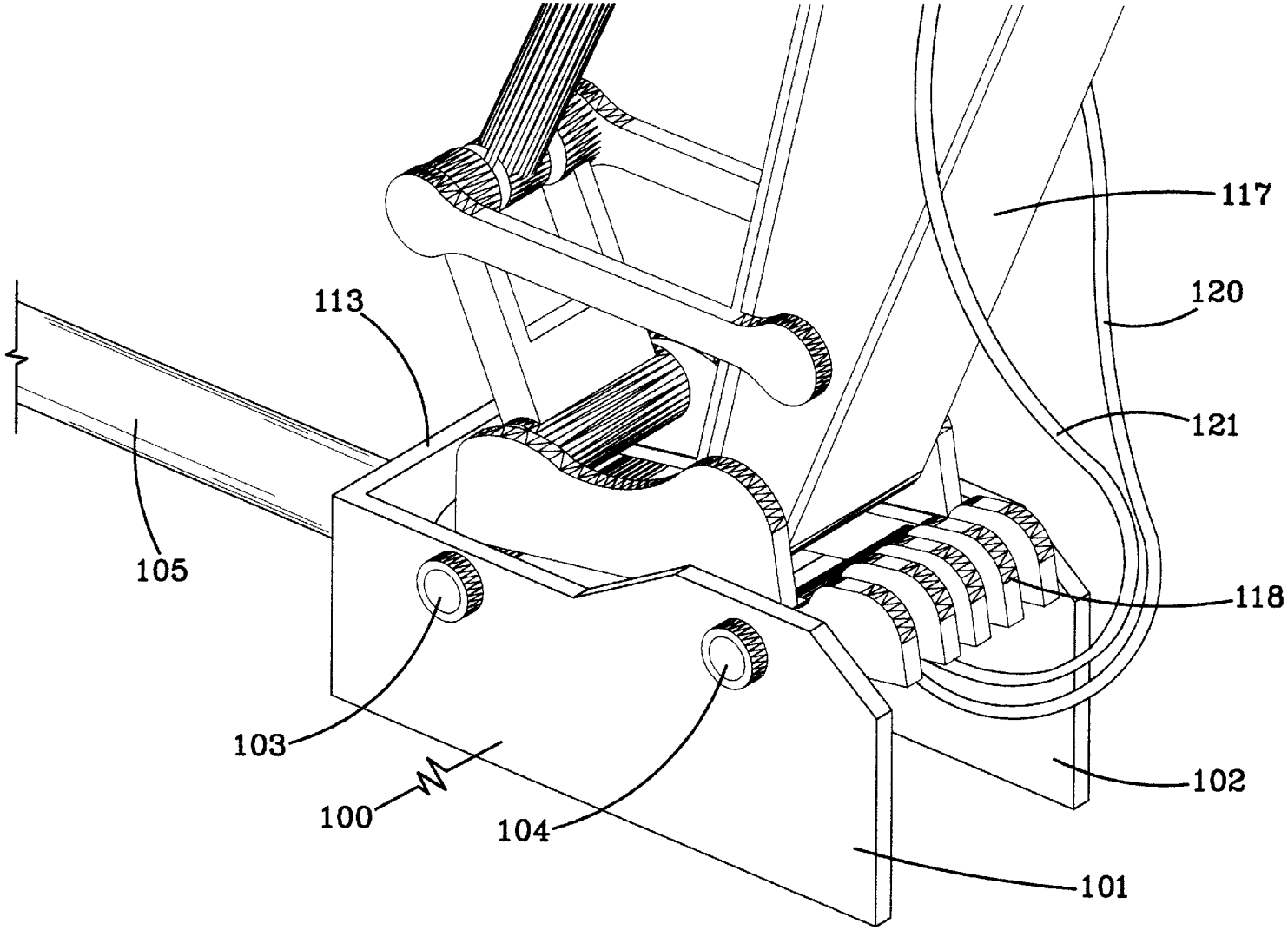
FIG. 3 is a perspective view of a portion of the rear of the assembly of this invention in engagement with a backhoe.
Figure 4:
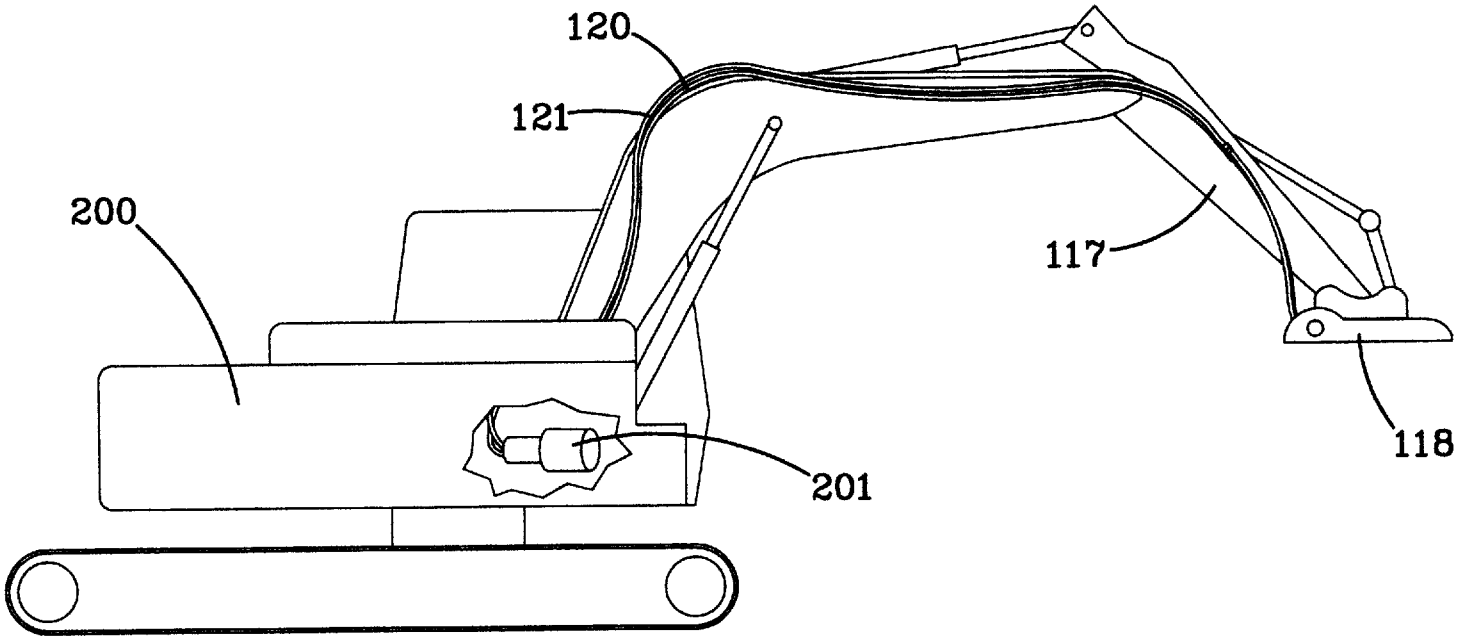
FIG. 4 is a schematic view of the backhoe.

Referring now to the drawings, the specific example of the invention shown therein comprises the combination of a frame 100 having side plates 101 and 102 and end plates 113 and 115 with flanges 114 and 116, typically made of one-inch steel, a steel casing 110 attached and supported by the frame, and an earth-moving auger 99 comprising auger shaft 108 and teeth 111 and spaced within and supported by said casing 110. The auger extends to and is actuated by an hydraulic motor 106 spaced within and supported by the frame 100. The frame 100 has transverse shafts 103 and 104. The shafts 103 and 104 permit a backhoe arm 117 to pick up and move the frame 100 and auger 99 to a desired position. The hydraulic motor 106 has quick-release couplings and hoses 120,121 for connection to the hydraulic pump 201 of a backhoe 200 and drive 106*a* attached to flange 116 mounted on rear face 115 of the frame. The motor shaft 107 is joined by connector 109 to auger shaft 108. A typical size of the auger drill bit 112 is 6 inches (7 inches forward and 5½ inches backward). The power of the hydraulic motor is in the range of 20 to 60 cubic inches, depending on the type of soil and the diameter of the pipeline section being installed. The normal bucket of the backhoe 117 is replaced by quick-coupling arms 118 which grip shafts 103 and 104 so that the backhoe operation can easily move the frame and auger.

Before beginning the boring under the driveway or other similar structure, a trench is dug on either side to the desired depth. In preparation for the actual bore, the desired pipeline section 105, typically made of polyvinylchloride (PVC) of ¼ to ½ inch thickness, is slid over the steel casing 110 which houses the auger 99 to which is attached auger drill bit 112. The spacing between the outside diameter of the steel casing 110 and the inside diameter of the PVC pipeline section 105 is about ¼ inch. The backhoe operator grasps the frame 100, connects the hydraulic motor 106 to the backhoe hydraulic system via hoses 120 and 121, places the boring assembly into position, and then actuates the hydraulic system to begin the boring. The backhoe operator controls the grade, speed, and penetration rate. The torque of the auger is monitored by an hydraulic gauge. When the auger reaches the other side of the structure, the backhoe operator pulls the steel casing 110, auger 99, and bit 112 backwards and out, leaving the PVC pipeline section 105 embedded in place in the soil.

I claim:

1. A tool for installing a length of pipe under a structure, comprising: a steel housing which supports an hydraulic motor means, a steel casing, an auger within the casing, and a soil moving drilling bit attached to said auger; said hydraulic motor means driving said auger; said steel casing being adaptable to receive and hold a selected length of pipe on its periphery; said tool being so characterized that when the bit on said auger has been driven into the soil, the drilling bit, auger, steel casing, and pipe are positioned in the soil, but when the steel casing, auger, and drilling bit are withdrawn, the length of pipe remains positioned in the soil.

2. The combination of the tool of claim 1 with an hydraulic power means connected to and operative on said hydraulic motor means.

3. The combination of the tool of claim 1 with means for moving said tool.

4. The combination of the tool of claim 1 with an hydraulic power means connected to and operative on said hydraulic motor means and means for moving said tool.

5. The tool of claim 1 wherein there is a transverse shaft in the housing.

6. The combination of the tool of claim 5 and a backhoe having gripping means operative on said shaft for moving said tool.

7. The combination of the tool of claim 5 and a backhoe equipped with hydraulic power means connected to and operative on said hydraulic motor means.

8. The combination of the tool of claim 5 and a backhoe having gripping means operative on said shaft for moving said tool and equipped with hydraulic power means connected to and operative on said hydraulic motor means.

* * * * *